US007029344B2

(12) United States Patent
Tsumiyama et al.

(10) Patent No.: US 7,029,344 B2
(45) Date of Patent: Apr. 18, 2006

(54) REVERSE SYSTEM FOR WATER-JET PROPULSION PERSONAL WATERCRAFT

(75) Inventors: Yoshinori Tsumiyama, Miki (JP); Yoshiyuki Kuroyanagi, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/987,336

(22) Filed: Nov. 12, 2004

(65) Prior Publication Data

US 2005/0118899 A1 Jun. 2, 2005

(30) Foreign Application Priority Data

Nov. 14, 2003 (JP) ..... 2003-384526

(51) Int. Cl.
*B63H 11/11* (2006.01)

(52) U.S. Cl. ..... 440/41

(58) Field of Classification Search ..... 440/38, 440/39, 40, 41, 42, 43
See application file for complete search history.

(56) References Cited

U.S. PATENT DOCUMENTS 6,267,633 B1 * 7/2001 Suganuma ..... 440/41
6,428,370 B1 * 8/2002 Jones ..... 440/41
6,652,332 B1 * 11/2003 Westhoff ..... 440/41

FOREIGN PATENT DOCUMENTS

JP 09-132196 5/1997
JP 2000-190895 7/2000

* cited by examiner

*Primary Examiner*—Lars A. Olson
(74) *Attorney, Agent, or Firm*—Alleman Hall McCoy Russell & Tuttle LLP

(57) ABSTRACT

A reverse system for a water-jet propulsion personal watercraft is disclosed, including a water jet pump configured to eject water rearward from a steering nozzle thereof to thereby propel the watercraft, the steering nozzle being pivotable rightward and leftward, and a reverse bucket disposed rearward of the water jet pump and configured to be vertically pivotable and to have a substantially bowl-shaped inner wall, the reverse bucket being configured to direct the water ejected from the steering nozzle and colliding with the inner wall substantially forward with the reverse bucket located at the lower position, to propel the watercraft rearward, wherein the reverse bucket includes fins provided on the inner wall of the reverse bucket and configured to protrude inward of the inner wall and to extend in substantially a longitudinal direction of the watercraft.

8 Claims, 9 Drawing Sheets

REVERSE SYSTEM FOR WATER-JET PROPULSION PERSONAL WATERCRAFT

BACKGROUND OF THE INVENTION

1. Field of the Invention

The present invention relates to a reverse system for a water-jet propulsion personal watercraft. More particularly, the present invention relates to a structure of a reverse bucket used for changing a direction of water flow during rearward travel of the water-jet propulsion personal watercraft.

2. Description of the Related Art

In recent years, water-jet propulsion personal watercraft have been widely used in leisure, sport, rescue activities, and the like. The personal watercraft is configured to accommodate an engine within a body formed by a hull and a deck covering the hull from above. The engine is configured to drive a water jet pump, which pressurizes and accelerates water sucked from a water intake generally provided on a hull bottom surface and ejects it rearward from an outlet port. As a result, the personal watercraft is propelled.

In water-jet propulsion personal watercraft, a steering nozzle is provided behind the water jet pump to be pivotable either to the right or to the left, and is connected to a bar-type steering handle attached to a front portion of the body through a cable. When an operator operates the steering handle, the steering nozzle is pivotable to the right or to the left so that a flow direction of water ejected from the water jet pump can be changed.

Japanese Patent Nos. 2756434 and 3358718 disclose a construction in which a reverse bucket is provided behind a water jet pump to cover a steering nozzle. The reverse bucket is vertically pivotable. When the reverse bucket is pivoted downward to a lower position, water ejected from the steering nozzle collides with an inner wall of the reverse bucket and is thereby directed substantially forward. As a result, the watercraft is propelled rearward.

In the above described reverse bucket, after the collision with the inner wall, the jet flow is scattered forward and to the right or to the left in an extensive angular range. In this reverse bucket, a propulsion force for moving the watercraft rearward is not sufficiently gained when the engine is running at a low speed, for example, in an idle state. So, it may be necessary to open a throttle to increase the water ejected from the steering nozzle to move the watercraft rearward only a small distance. Such deficiency of the propulsion force also arises when the watercraft is turning to the right or to the left during rearward travel. In that case, the scattered jet flow may impede improvement of turning capability of the watercraft traveling rearward.

In another prior art, a reverse bucket provided with holes on right and left walls is used to eject small amounts of water through these holes to gain a propulsion force for turning a watercraft, thereby improving turning capability during rearward travel. In this reverse bucket, however, a steering direction of a bar-type steering handle does not conform to a turning direction of the watercraft. Accordingly, it would be desirable to provide a watercraft in which the steering direction of the steering handle conforms to the turning direction of the watercraft while improving the turning capability during the rearward travel of the watercraft.

SUMMARY OF THE INVENTION

The present invention addresses the above described conditions, and an object of the present invention is to provide a reverse system of a water-jet propulsion personal watercraft, which is capable of sufficiently gaining a propulsion force for moving the watercraft rearward and of improving turning capability during rearward travel of the watercraft by inhibiting water flow, which collides with an inner wall of the reverse bucket and is directed substantially forward, from being scatted to the right or to the left.

According to the present invention, there is provided a reverse system for a water-jet propulsion personal watercraft, comprising a water jet pump configured to eject water rearward from a steering nozzle thereof to thereby propel the watercraft, the steering nozzle being pivotable rightward and leftward, and a reverse bucket disposed rearward of the water jet pump and configured to be vertically pivotable and to have a substantially bowl-shaped inner wall, the reverse bucket being configured to direct the water ejected from the steering nozzle and colliding with the inner wall substantially forward with the reverse bucket located at the lower position, to propel the watercraft rearward, wherein the reverse bucket includes fins provided on the inner wall of the reverse bucket and configured to protrude inward of the inner wall and to extend in substantially a longitudinal direction of the watercraft.

In the above construction, since the flow of the water colliding with the inner wall of the reverse bucket and directed substantially forward is controlled by the fins, so that the water is inhibited from being scattered to the right or to the left and thereby directed substantially straight forward, the propulsion force for moving the watercraft rearward can be improved.

The fins may include side fins provided on the inner wall of the reverse bucket to be located on right and left sides relative to a center in a width direction of the water jet pump. The side fins can effectively inhibit the water that collides with the reverse bucket and is directed substantially forward from being scattered to the right and to the left. Therefore, the propulsion force for moving the watercraft can be improved.

The side fins are respectively disposed on a substantially left side of a portion of the inner wall of the reverse bucket, at a location which is opposite a rear end of the steering nozzle when pivoted to a leftmost position, and on a substantially right side of a portion of the inner wall of the reverse bucket, at a location which is opposite the rear end of the steering nozzle when pivoted to a rightmost position.

By pivoting the steering nozzle to the right or to the left to turn the watercraft when the watercraft is traveling rearward, it is possible to effectively inhibit the water ejected from the steering nozzle and colliding with the reverse bucket from being scattered to the right or to the left. As a result, the propulsion force can be improved and response of the turning of the body to the steering operation can be improved when the watercraft is traveling rearward and turning.

The fins may include center fins provided on the inner wall of the reverse bucket to be located on right and left sides relative to the center in the width direction of the water jet pump and between the side fins and configured to extend in substantially the longitudinal direction of the watercraft. The center fins can enhance the function of water flow control for the water, thereby increasing the propulsion force.

side fins may be configured to protrude further than the center fins. In such a structure, it is possible to effectively inhibit the water that collides with the inner wall of the base portion and is directed substantially forward from being scattered to the right or to the left.

The side fins may be configured such that a distance between the side fins decreases in a direction from front portions of the side fins to rear portions of the side fins. Likewise, the center fins may be configured such that a distance between the center fins decreases in a direction from front portions of the center fins to rear portions of the center fins. In such a structure, the flow of the water, which collides with the inner wall of the reverse bucket and is directed substantially forward, is directed substantially straight forward by inhibiting the water from being scattered to the right or to the left.

The above and further objects and features of the invention will more fully be apparent from the following detailed description with the accompanying drawings.

DETAILED DESCRIPTION OF THE PREFERRED EMBODIMENTS

Figure 1:
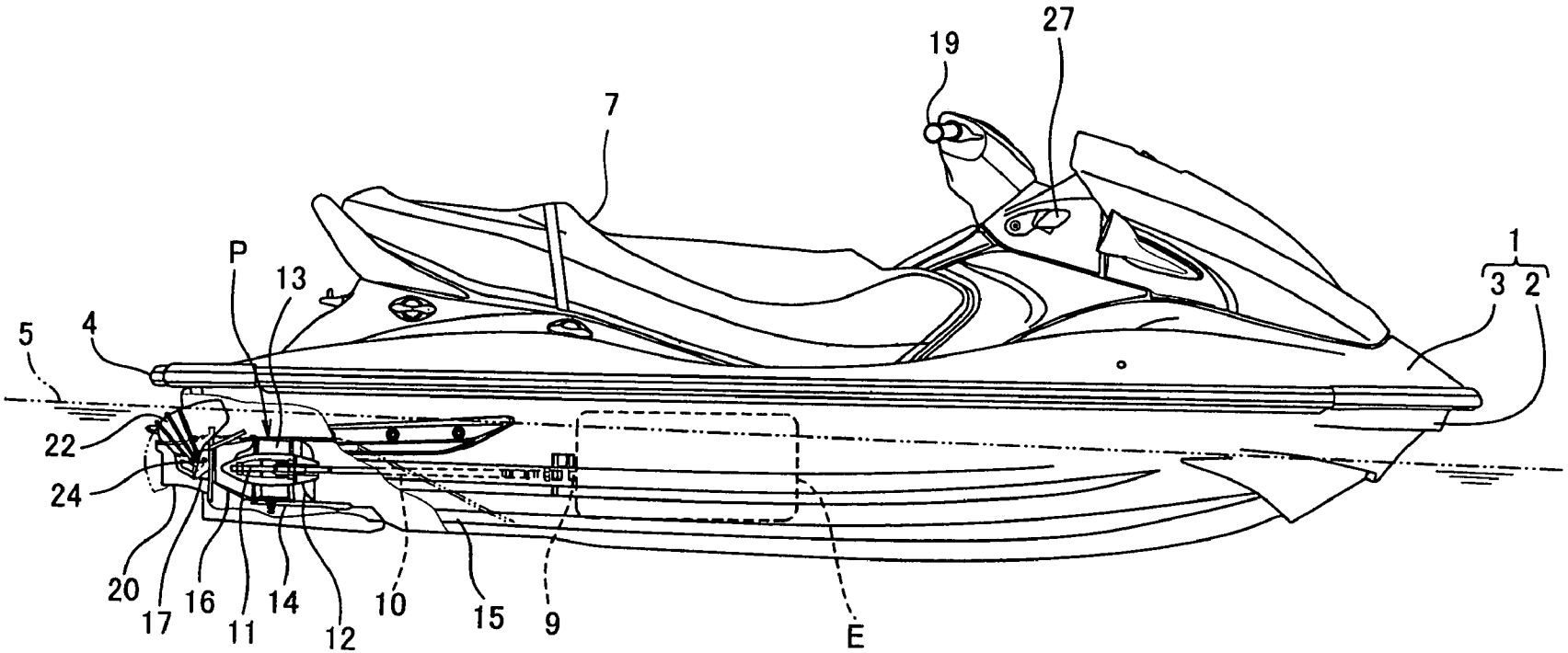
FIG. 1 is a side view of a personal watercraft according to an embodiment of the present invention.

Hereinafter, a reverse system of a water-jet propulsion personal watercraft according to an embodiment of the present invention will be described with reference to drawings. The personal watercraft in FIG. 1 is a straddle-type personal watercraft equipped with a straddle-type seat 7 configured to be straddled by a rider. A body 1 of the watercraft is formed by a hull 2 and a deck 3 covering the hull 2 from above. A line at which the hull 2 and the deck 3 are connected over the entire perimeter thereof is called a gunnel line 4. The gunnel line 4 is located above a waterline 5 of the personal watercraft being at rest on the water. Herein, directions are described as seen from the perspective of the rider straddling the seat 7, and looking ahead over the bow of the watercraft. The term "longitudinal direction" is used to refer to an orientation extending from bow to stern of the watercraft, while the term "lateral direction" is used to refer to an orientation extending from starboard to port of the watercraft.

Figure 2:
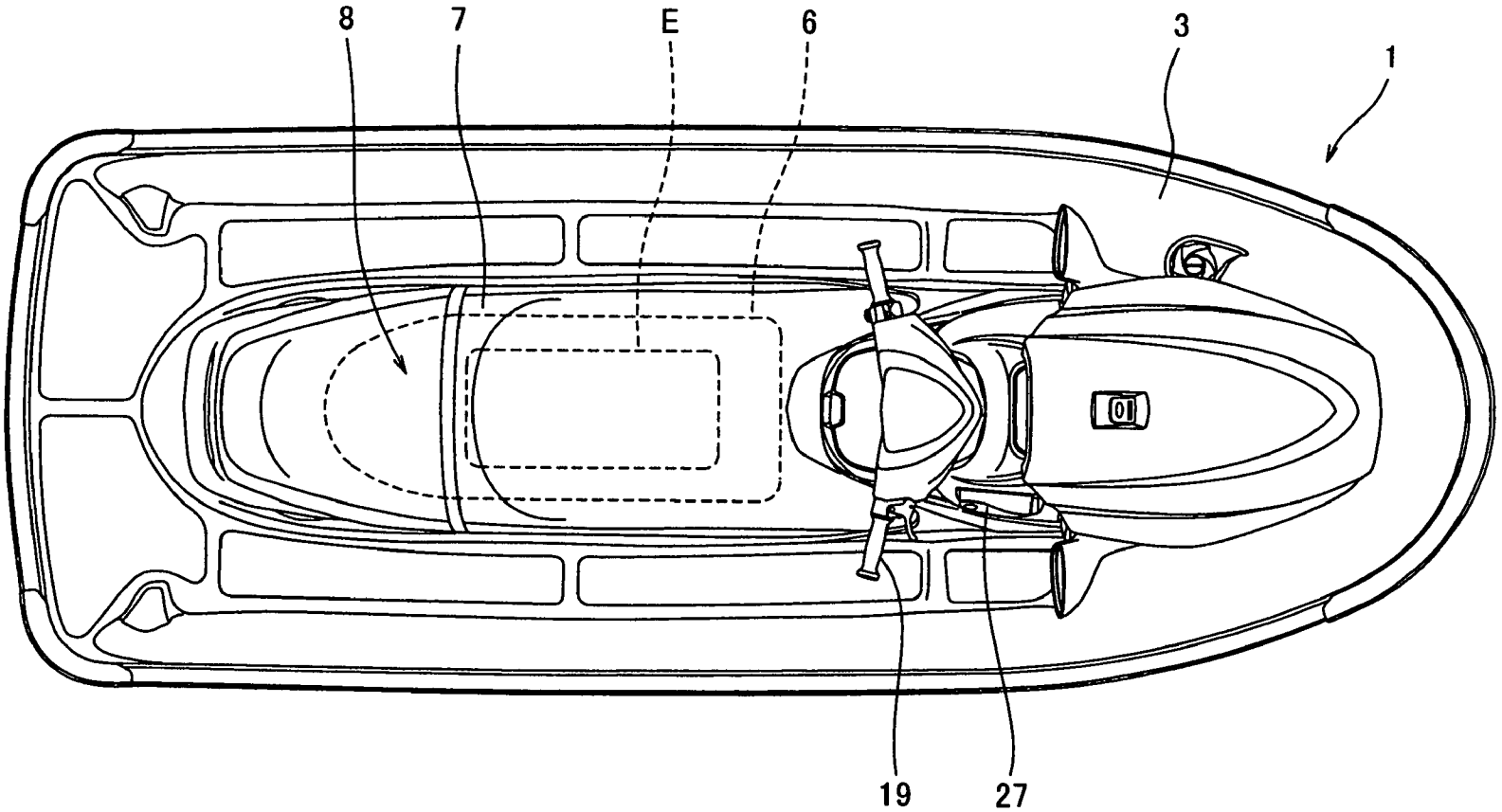
FIG. 2 is a plan view of the personal watercraft in FIG. 1.

As shown in FIG. 2, a deck opening 6, which has a substantially rectangular shape seen from above, is formed on an upper portion of the body 1 at substantially a center section of the deck 3 in the longitudinal and lateral directions of the body 1 to extend in the longitudinal direction of the body 1. The straddle-type seat 7 is removably mounted over the deck opening 6 and configured to be straddled by the rider.

An engine room 8 is formed by a space defined by the hull 2 and the deck 3 below the deck opening 6. An engine E is accommodated within the engine room 8 and configured to drive the watercraft. The engine room 8 has a convex-shaped transverse cross-section and is configured such that its upper portion is smaller than its lower portion. The engine E is accommodated within the engine room 8 such that a crankshaft 9 extends along the longitudinal direction of the body 1 as shown in FIG. 1.

An output end of the crankshaft 9 is integrally and rotatably coupled with a pump shaft 11 of a water jet pump P disposed at a rear portion of the body 1 through a drive shaft 10. An impeller 12 is attached on the pump shaft 11 of the water jet pump P. Fairing vanes 13 are provided behind the impeller 12. The impeller 12 is covered with a pump casing 14 on the outer periphery thereof.

Figure 3:
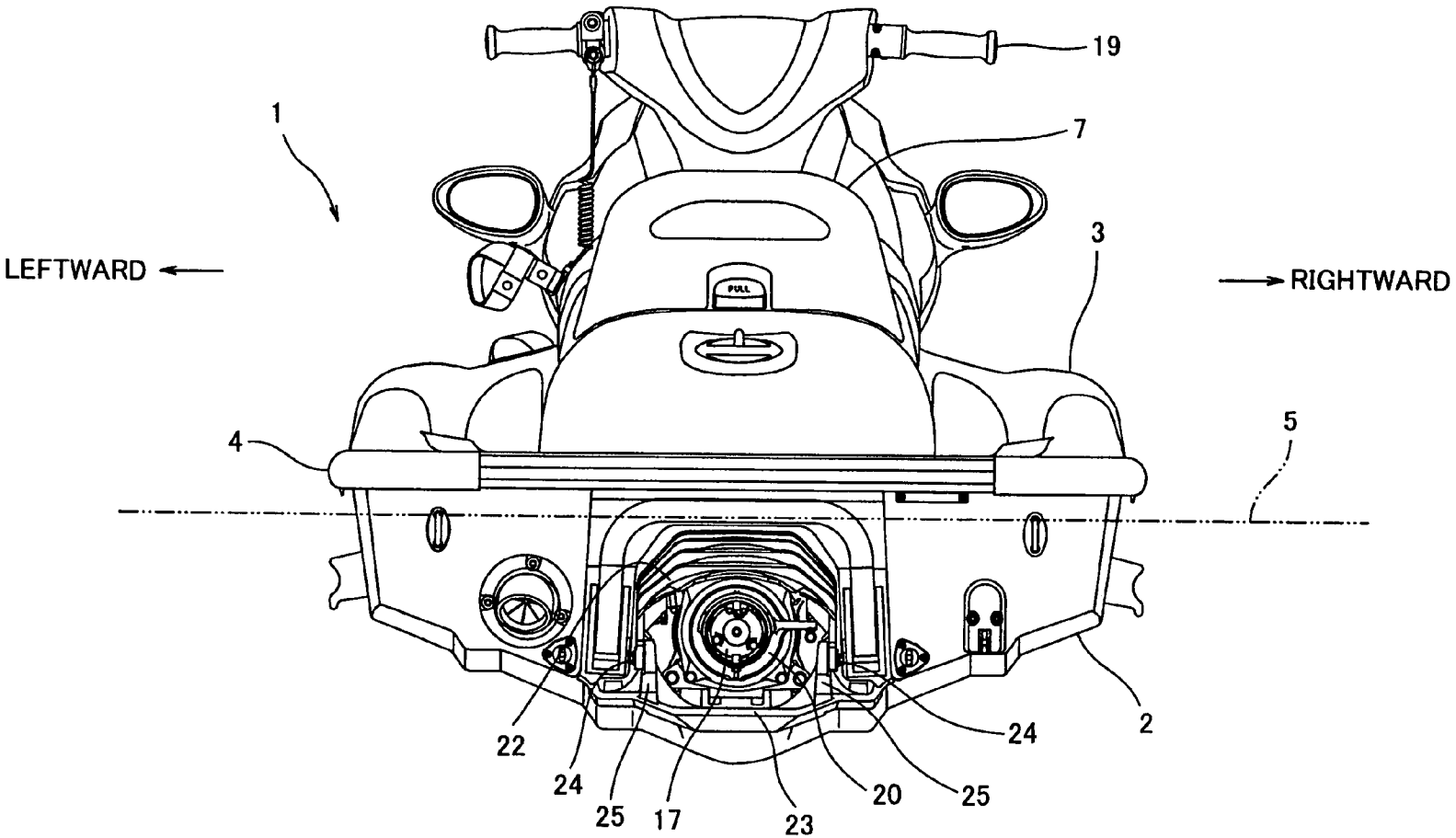
FIG. 3 is a rear view of the personal watercraft in FIG. 1.

A water intake 15 is provided on the bottom of the body 1. The water intake 15 is connected to the pump casing 14 through a water passage. The pump casing 14 is connected to the pump nozzle 16 provided at the rear portion of the body 1. The pump nozzle 16 has a cross-sectional area of flow that is gradually reduced rearward. As shown in FIG. 3, an outlet port 17 is formed at a rear end of the pump nozzle 16.

The water jet pump P pressurizes and accelerates the water sucked from the water intake 15, and the fairing vanes 13 guide the water. The pressurized and accelerated water is discharged rearward through the pump nozzle 16, and from the outlet port 17, and as the resulting reaction, the watercraft obtains a propulsion force.

Figure 8:
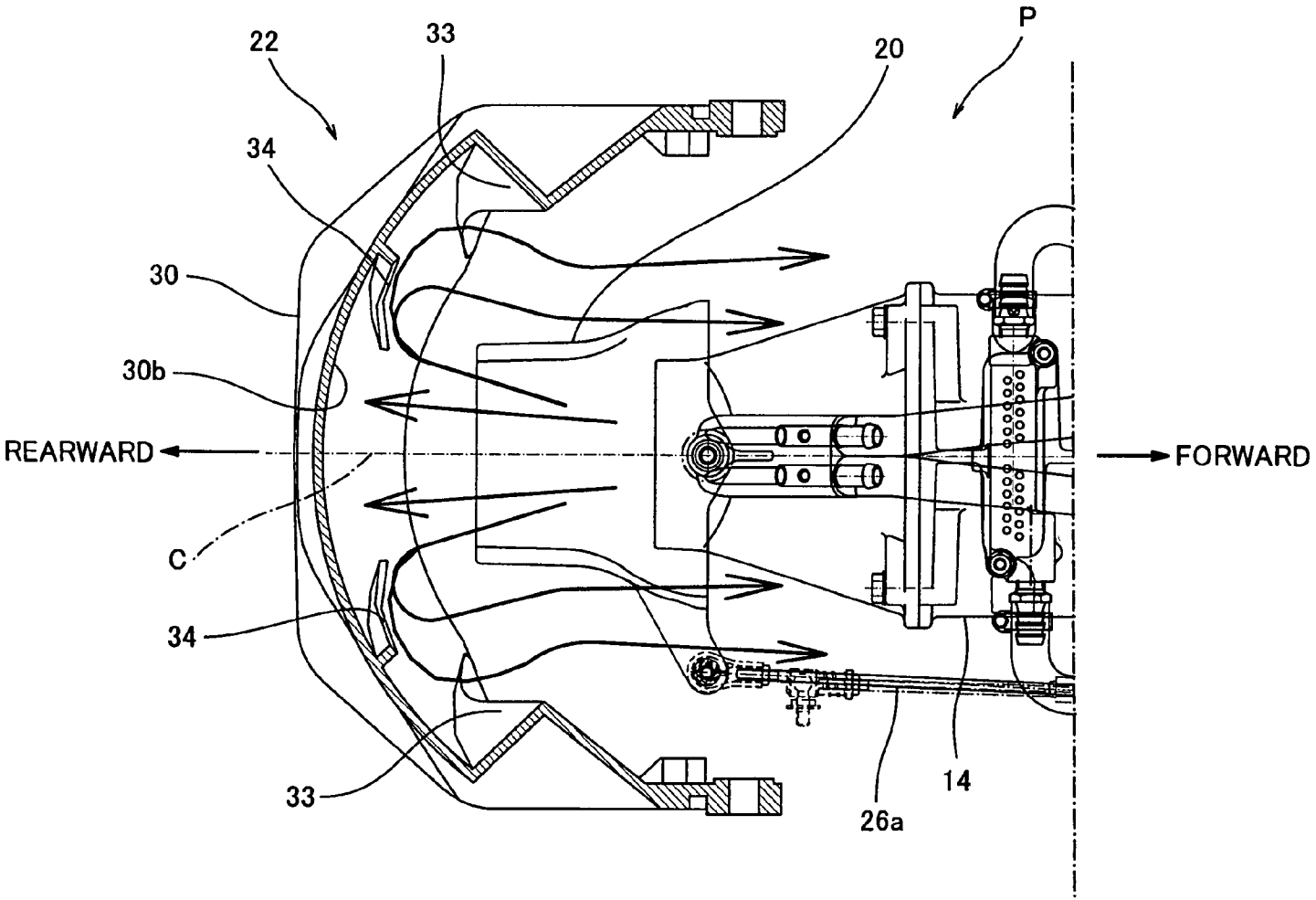
FIG. 8 is a enlarged plan view of the rear portion of the water jet pump, part of which is illustrated in cross section, showing a flow of water ejected from a steering nozzle when the personal watercraft in FIG. 1 is traveling straight rearward.

A bar-type steering handle 19 is attached to a front portion of the deck 3. The steering handle 19 is connected to the steering nozzle 20 (see FIG. 3) disposed behind the pump nozzle 16 through a cable 26*a* (FIG. 8). When the rider rotates the steering handle 19 clockwise or counterclockwise, the steering nozzle 20 is pivoted clockwise or counterclockwise. By operating the steering handle 19, the direction of the water ejected outside through the pump nozzle 16 is changed, and the turning direction of the watercraft is changed, while the water jet pump P is generating the propulsion force.

Figure 4:
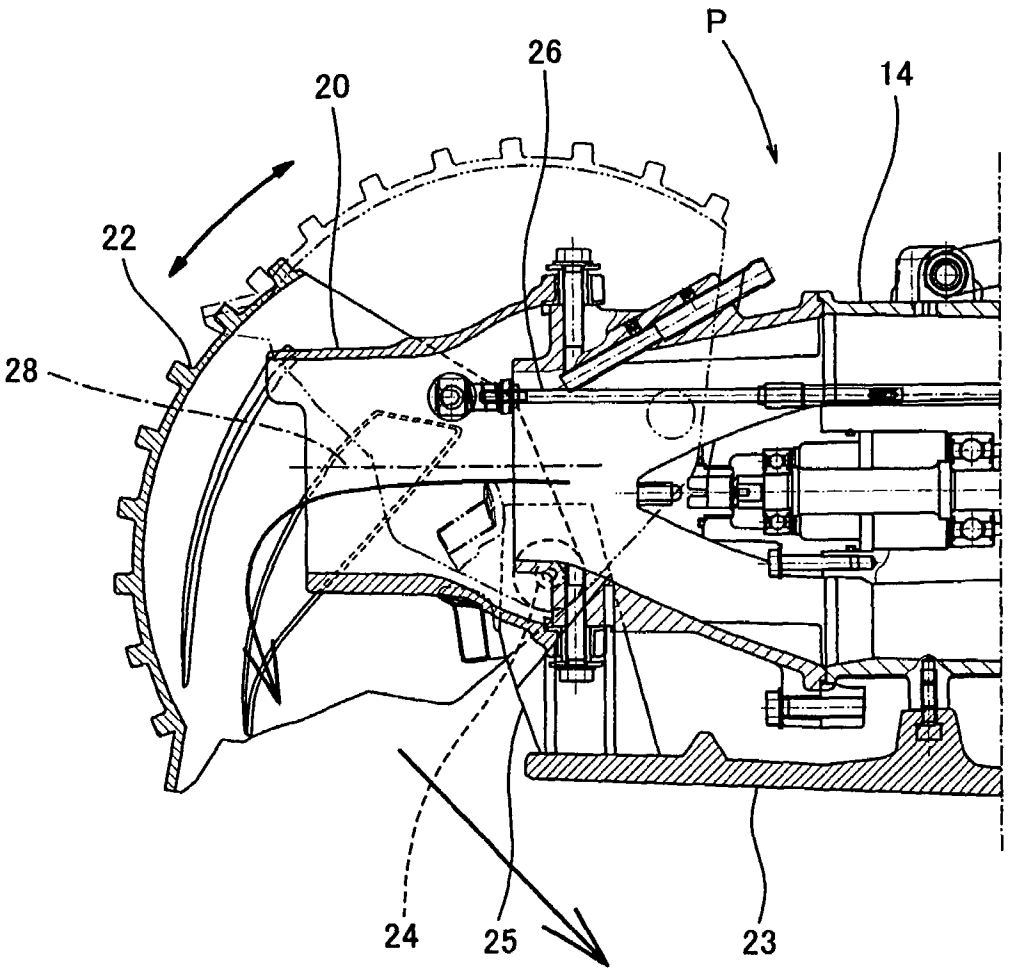
FIG. 4 is an enlarged side cross-sectional view showing a rear portion of a water jet pump in FIG. 1.

FIG. 4 is an enlarged side view of the rear portion of the water jet pump P. As shown in FIG. 4, a bowl-shaped reverse bucket 22 is provided substantially above the steering nozzle 20. A pump cover 23 is provided under the pump casing 14 to cover the pump casing 14 from below. Pivot portions 25 are vertically mounted to a rear portion of the pump cover 23 to allow the reverse bucket 22 to be pivotable around pivot shafts 24, between an upper position (shown in double dot dashed lines) and a lower position (shown in solid lines). As shown in FIG. 3, the pivot portions 25 are positioned on right and left sides of the pump cover 23. One end of the cable 26 is connected to the reverse bucket 22 at a position distant from the pivot shafts 24 and the other end thereof is connected to a reverse lever 27 (see FIG. 1).

By operating the reverse lever 27, the reverse bucket 22 is vertically pivotable around the pivot shafts 24 as shown in FIG. 4. When the reverse bucket 22 is pivoted downward to a lower position around the pivot shafts 24, to be positioned behind the steering nozzle 20, the water ejected rearward from the steering nozzle 20 collides with an inner wall of the reverse bucket 22 and is ejected substantially forward. As a result, the watercraft is propelled rearward. In FIG. 4, a center line 28 of a flow cross-sectional area of the water ejected from the steering nozzle 20 is represented by a dashed line.

Figure 5A:
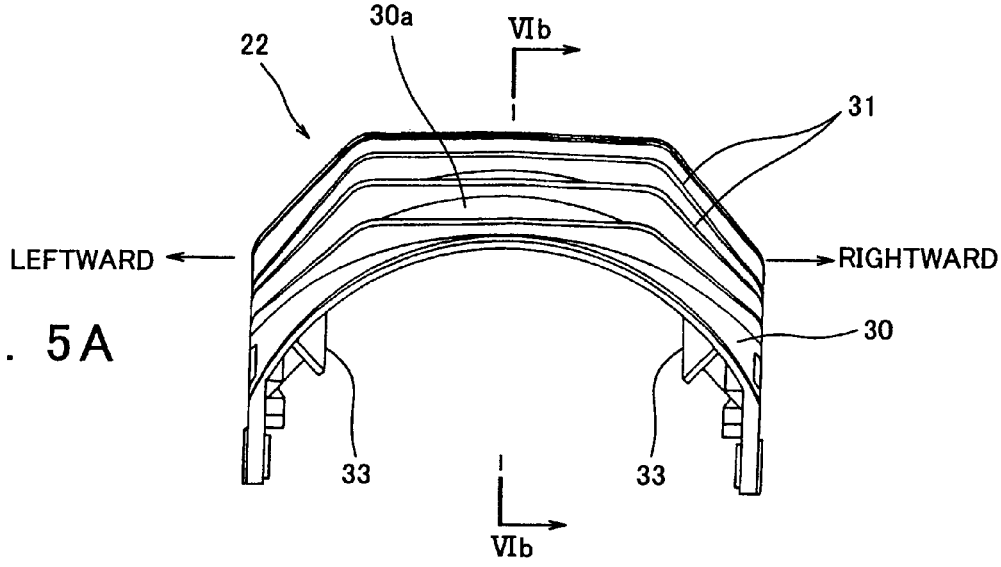
FIG. 5A is a rear view of a reverse bucket in FIG. 4.
Figure 5B:
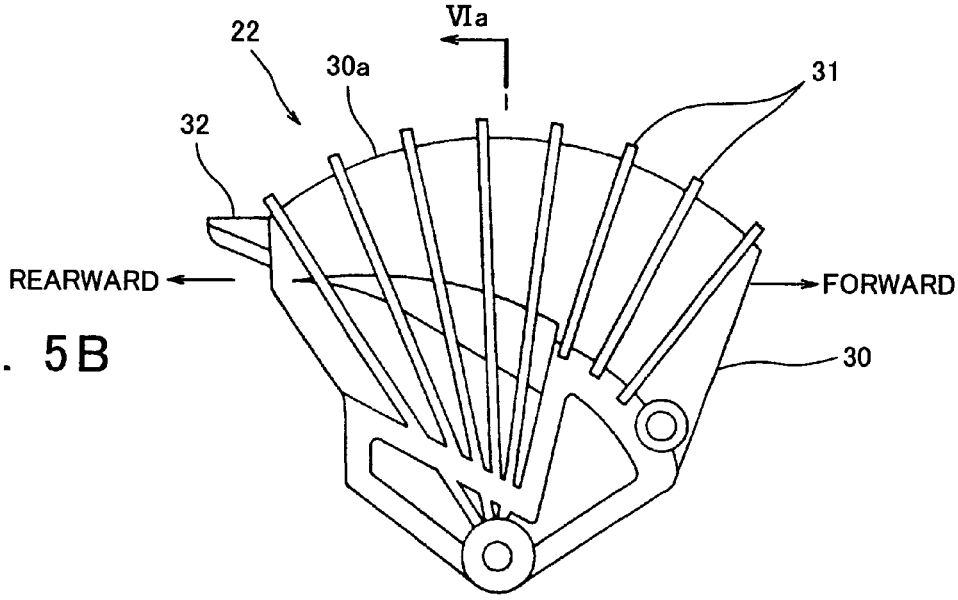
FIG. 5B is a side view of the reverse bucket in FIG. 4.
Figure 6A:
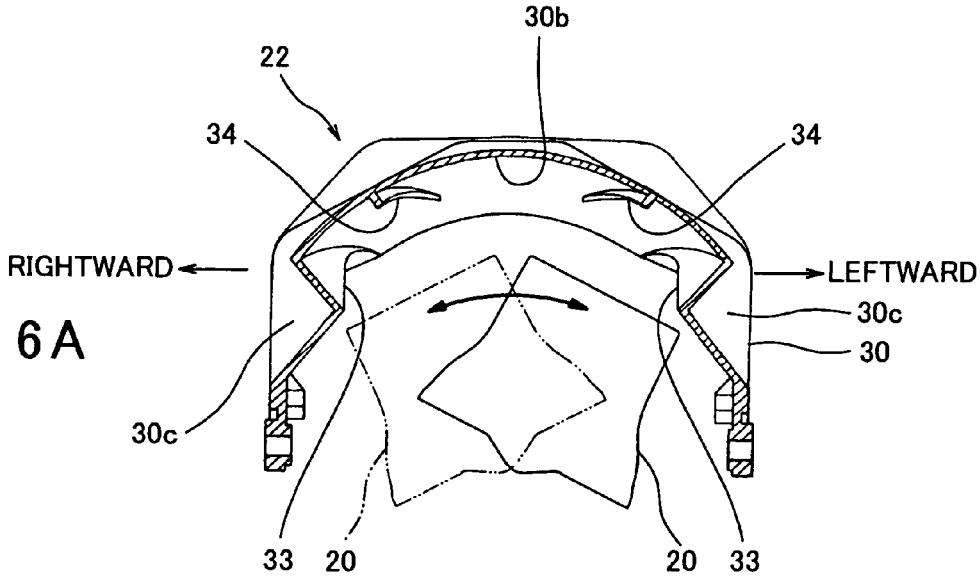
FIG. 6A is a cross-sectional view of the reverse bucket taken along line VIa—VIa in FIG. 5B.
Figure 6B:
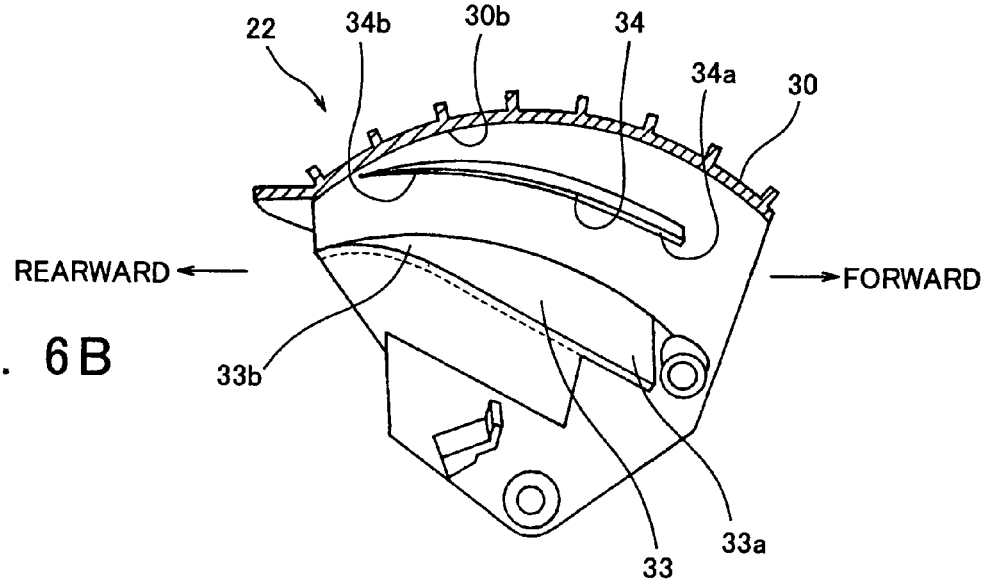
FIG. 6B is a cross-sectional view of the reverse bucket taken along line VIb—VIb in FIG. 5A.
Figure 7:
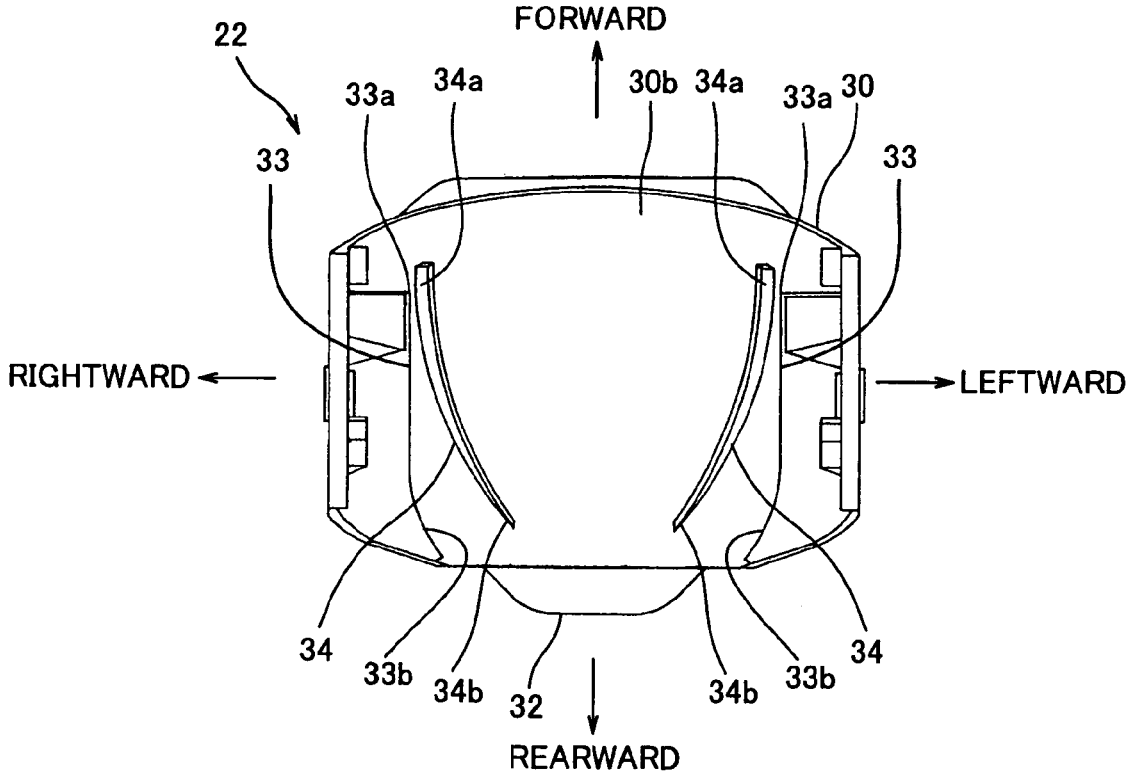
FIG. 7 is a bottom view of the reverse bucket in FIGS. 5A and 5B.

FIG. 5A is a rear view showing a structure of the reverse bucket 22. FIG. 5B is a side view showing the structure of the reverse bucket 22. FIG. 6A is a cross-sectional view of the reverse bucket 22 taken along line VIa—VIa in FIG. 5B. FIG. 6B is a cross-sectional view of the reverse bucket 22 taken along line VIb—VIb in FIG. 5A. FIG. 7 is a rear view showing the structure of the reverse bucket 22.

As shown in FIGS. 5A and 5B, the reverse bucket 22 is structured such that a number of ribs 31 are arranged in the longitudinal direction of the body 1 on an outer wall 30*a* of a bowl-shaped base portion 30 to extend in the lateral direction of the body 1. The reverse bucket 22 is typically made of synthetic resin. The ribs 31 provide rigidity for the reverse bucket 22. It will be appreciated that ribs 31 may be omitted, for example, if the reverse bucket 22 is made of a rigid material sufficient to avoid performance degrading deformation during use. A flange portion 32 is provided at a rear end portion of the base portion 30.

As shown in FIGS. 6A, 6B, and 7, a number of fins are provided on an inner wall 30*b* of the base portion 30 of the reverse bucket 22. Specifically, right and left side fins 33 are provided on right and left portions of the inner wall 30*b* of the base portion 30 to protrude inward from the inner wall 30*b* of the reverse bucket 22. More specifically, the right and left side fins 33 are provided on the inner wall 30*b* to be located on right and left sides relative to a center C (FIG. 8) in a width direction of the water jet pump P, and more precisely, relative to the center C in the width direction of the outlet port 17 of the pump nozzle 16. Two center fins 34 are provided on the inner wall 30*b* of the base portion 30 to be located between the side fins 33 and configured to protrude inward to have a height smaller than that of the side fins 33. The size of center fins 34 may vary (and thus their height may be increased), but typically center fins 34 are sized to avoid contact with the rear end of the steering nozzle 20 when the reverse bucket 22 is vertically pivoted. The number of the center fins 34 may be suitably changed to achieve a desired water flow control function of the reverse bucket 22.

The right and left side fins 33 extend substantially along the longitudinal direction of the body 1, and respective portions of the fins 33 also are oriented toward each other such that a distance between the fins 33 decreases from front portions 33*a* to rear portions 33*b*. The height of side fins 33 is reduced in the direction from the front portions 33*a* to the rear portions 33*b*, so as not to interfere with the steering nozzle 20. The center fins 34 extend substantially along the longitudinal direction of the body 1, and are oriented such that a distance between the fins 34 decreases from front portions 34*a* to rear portions 34*b*. The height of center fins 34 is reduced in the direction from the front portions 34*a* to the rear portions 34*b*, so as not to interfere with the steering nozzle 20.

The side fins 33 are provided at predetermined positions on the right and left sides of the inner wall 30*b* of the base portion 30. As shown in FIG. 6A, the steering nozzle 20 is pivotable to the right or to the left in a predetermined angular range within the reverse bucket 22. The left side fin 33 is located on a substantially left side of a portion of the inner wall 30*b* of the base portion 30, which is opposite a rear end of the steering nozzle 20 when pivoted to a leftmost position. More specifically, the left side fin 33 is configured to protrude at a position rearward relative to a left end of a rear portion of the steering nozzle 20 in the flow direction of the water flow ejected from the steering nozzle 20. The right side fin 33 is located on a substantially right side of a portion of the inner wall 30*b* of the base portion 30, which is opposite the rear end of the steering nozzle 20 when pivoted to a rightmost position. More specifically, the right side fin 33 is configured to protrude at a position rearward relative to a right end of the rear portion of the steering nozzle 20 in the flow direction of the water ejected from the steering nozzle 20.

As shown in FIG. 6A, in this embodiment, the side fins 33 are formed by bending right and left portions of the base portion 30 of the reverse bucket 22. Bent portions 30*c* are bent in substantially a V-shape in transverse cross section, and are provided on the right and left portions of the base portion 30 so as to extend along the longitudinal direction of the body 1. The bent portions 30*c* form the side fins 33 as seen from the inside of the reverse bucket 22. Since the side fins 33 are formed by the right and left bent portions 30*c* of the base portion 30, they have high mechanical strength.

The side fins 33 and the center fins 34 also function as ribs for giving a rigidity to the reverse bucket 22. The extension direction of the ribs 31 formed on the outer wall 30*a* of the base portion 30 substantially crosses the extension direction of the side fins 33 and the center fins 34. In this structure, the reverse bucket 22 has a sufficient rigidity against an impact force externally applied from all directions.

Subsequently, the rearward travel of the personal watercraft equipped with reverse bucket 22 will be described. FIG. 8 is an enlarged plan view showing the rear portion of the water jet pump P, a part of which is illustrated in cross section, and a flow of the water ejected from the steering nozzle 20 when the watercraft is traveling straight rearward. As shown in FIG. 8, the water ejected rearward from the steering nozzle 20 collides with the inner wall 30*b* of the reverse bucket 22 and thereby runs substantially forward. The flow of the water is controlled by the restriction of the side fins 33 to be directed substantially straight forward by inhibiting the water from being scattered to the right or to the left. In addition, the water is controlled by the center fins 34 to be smoothly directed substantially straight forward.

Since the reverse bucket 22 allows the water ejected from the steering nozzle 20 to be directed substantially straight forward efficiently during the rearward travel of the watercraft as described above, a sufficient propulsion force for moving the watercraft rearward is gained even in a low-output engine state, for example, an idling state.

Figure 9:
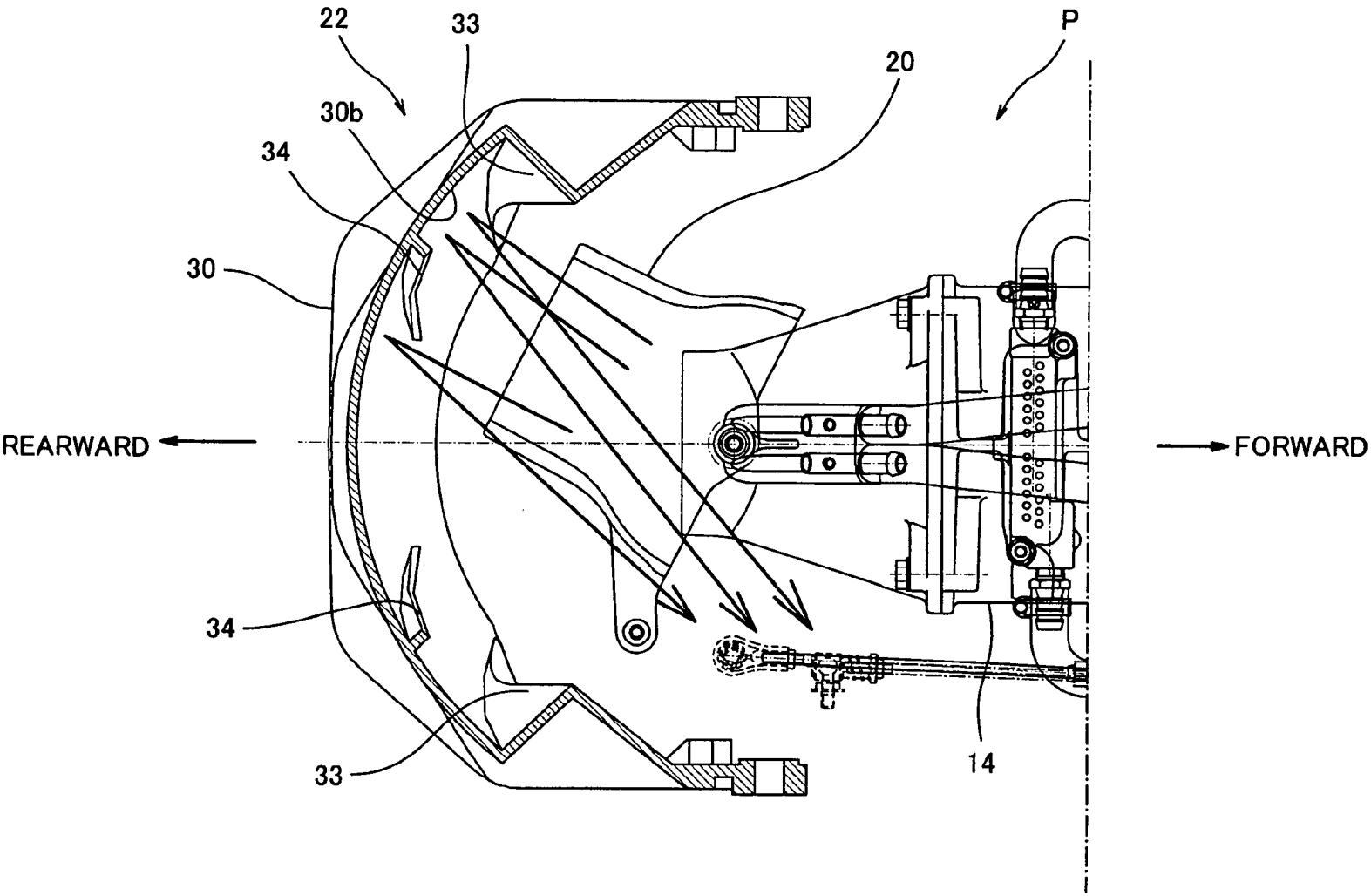
FIG. 9 is an enlarged plan view of the rear portion of the water jet pump, part of which is illustrated in cross section, showing a flow of the water ejected from the steering nozzle when the personal watercraft in FIG. 1 is traveling rearward and turning.

FIG. 9 is an enlarged plan view showing the rear portion of the water jet pump P, a part of which is illustrated in cross section, and a flow of the water ejected from the steering nozzle 20, when the watercraft is traveling rearward and turning, for example, to the left. By operating the steering handle 19, the steering nozzle 20 is directed to the left when the watercraft is turning to the left as shown in FIG. 9. The water ejected leftward and rearward from the steering nozzle 20 collides with substantially a left part of the inner wall 30*b* between the right and left fins 33 of the reverse bucket 22 and thereby runs substantially forward. The flow direction of the water is restricted by the left side fin 33, thereby inhibiting the water from being scattered to the left of the reverse bucket 22. In addition, the flow direction of the water is controlled by the center fins 34 to be smoothly directed substantially rightward and forward. Likewise, when the watercraft is traveling rearward and turning to the right, the water ejected rearward and rightward from the steering nozzle 20 and colliding with the inner wall 30*b* of the reverse bucket 22 is inhibited from being scattered to the right by the right side fin 34 and smoothly directed substantially leftward and forward by the center fins 34.

In the above construction, while the watercraft is traveling rearward and turning, sufficient propulsion force and turning force can be gained. Consequently, the watercraft can move rearward and turn efficiently even in a low engine speed state, for example, an idling state.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A reverse system for a water-jet propulsion personal watercraft, comprising:

a water jet pump configured to eject water rearward from a steering nozzle thereof to thereby propel the watercraft, the steering nozzle being pivotable rightward and leftward; and a reverse bucket having a bowl-shaped inner wall and side provided on the inner wall to be located on right and left sides relative to a center in a with direction of the water jet pump, the reverse bucket being positioned rearward of the water jet pump and being configured to be vertically pivotable between an upper position and a lower position;

wherein the water jet pump is configured to eject water to collide with the inner wall of the reverse bucket when the reverse bucket is in the lower position;

wherein the bowl-shaped inner wall is curved to protrude rearward in a lateral direction and in a vertical direction when the reverse bucket is in the lower position;

wherein the side fins are configured to extend from an upper region to a lower region of the inner wall along the inner wall and to protrude inward from the inner wall in a manner such that a distance between the fins decreases as the fins protrude, when the reverse bucket is in the lower position; and wherein the reverse bucket in the lower position is configured to cause the water ejected from the water jet pump and flowing along the inner wall and the side fins to be directed substantially forward along a path that travels under the water let pump, to thereby propel the watercraft rearward.

2. The reverse system for a water-jet propulsion personal watercraft according to claim 1, wherein the side fins are respectively disposed on a substantially left side of a first portion of the inner wall of the reverse bucket, which first portion is opposite a rear end of the steering nozzle when pivoted to a leftmost position, and on a substantially right side of a second portion of the inner wall of the reverse bucket, which second portion is opposite the rear end of the steering nozzle when pivoted to a rightmost position.

3. The reverse system for a water-jet propulsion personal watercraft according to claim 1, further comprising:

center fins provided on the inner wall of the reverse bucket, on respective right and left sides relative to the center in the width direction of the water jet pump and between the side fins, wherein the center fins are configured to extend from an upper region to a lower region of the inner wall along the inner wall and to protrude inward from the inner wall in a manner such that a distance between them decreases as the fins protrude, when the reverse bucket is in the lower position.

4. The reverse system for a water-jet propulsion personal watercraft according to claim 3, wherein the side fins are configured to protrude further from the inner wall than the center fins.

5. The reverse system for a water-jet propulsion personal watercraft according to claim 1, wherein the side fins are configured such that a distance between the side fins decreases in a direction from upper portions of the side fins to lower portions of the side fins, when the reverse bucket is in the lower position.

6. The reverse system for a water-jet propulsion personal watercraft according to claim 3, wherein the center fins are configured such that a distance between the center fins decreases in a direction from upper portions of the center fins to lower portions of the center fins, when the reverse bucket is in the lower position.

7. The reverse system for a water-jet propulsion personal watercraft according to claim 5, wherein when the reverse bucket is in the lower position, a protruding dimension of each side fin from the inner wall of the reverse bucket to a respective front end of each side fin gradually decreases in a direction from a respective upper portion to a respective lower portion of each side fin.

8. The reverse system for a water-jet propulsion personal watercraft according to claim 6, wherein when the bucket is in the lower position, a protruding dimension of each center fin from the inner wall of the reverse bucket to a respective front end of each center fin gradually decreases in a direction from a respective upper portion to a respective lower portion of each center fin.

* * * * *